United States Patent [19]

Heckman et al.

[11] 4,009,681

[45] Mar. 1, 1977

[54] DEVICE FOR AUTOMATICALLY CLEANING MASKS IN POWDER COATING SYSTEM

[75] Inventors: Russell William Heckman, Perrysburg; George Allen Nickey, Toledo; John Edward Poole, Holland, all of Ohio

[73] Assignee: Owens-Illinois, Inc., Toledo, Ohio

[22] Filed: Apr. 16, 1976

[21] Appl. No.: 677,596

[52] U.S. Cl. ..... 118/70; 118/302; 118/504

[51] Int. Cl.[2] ..... B05C 11/14

[58] Field of Search ..... 118/17, 63, 70, 203, 118/213, 301, 302, 406, 503, 504; 15/21 E, 77, 312 R; 198/229

[56] References Cited

UNITED STATES PATENTS

| | | | |
|---|---|---|---|
| 2,974,631 | 3/1961 | Thompson | 118/70 |
| 3,641,618 | 2/1972 | Rainey et al. | 15/312 R |
| 3,830,196 | 8/1974 | Guttman et al. | 118/70 |
| 3,886,899 | 6/1975 | Johnson | 118/504 |
| 3,909,289 | 9/1975 | Foucart | 118/70 X |

*Primary Examiner*—Louis K. Rimrodt
*Attorney, Agent, or Firm*—J. R. Nelson

[57] ABSTRACT

Apparatus for automatically cleaning excess powder off the masking system of a powder spray unit in which articles, such as glass bottles, are spray coated over their surface exclusive of the neck finish area masked off by said masking system. Two cleaning devices as module units are located beyond the exit of the spray booth in the path of the masking shields. The cleaners function continuously during operation of the masks by engaging the shields in their travel by a pair of contoured rotary brushes, and plural stationary brushes. The brushes sweep the excess powder off the shaped masks in an enclosure kept under negative pressure. Air flow from the enclosure entrains dislodged powder and carries it to a collection system or to the powder supply for recycling and use in the spray system. A blow air assist may be employed to scrub powder loosened by the brushes from the workpiece being cleaned. Cleaning the masks repeatedly and automatically assures against powder residue contacting the bottle finish and prevents powder build-up which may be dislodged and form on the bottle coating as globs or cakes. Such globs when fused form a defect in the plastic coating on the bottle.

16 Claims, 6 Drawing Figures

DEVICE FOR AUTOMATICALLY CLEANING MASKS IN POWDER COATING SYSTEM

The invention relates to apparatus for coating of glass bottles, or like articles, by spray application of a particulate, finely divided fusible plastic compound, including a mask system shielding the conveying mechanism and a portion of the articles held thereby from an overspray of the compound. More particularly, the invention relates to apparatus used in conjunction with the mask system for automatically cleaning it in its cycle of operation.

BACKGROUND OF THE INVENTION

In U.S. Pat. No. 3,886,899, the overspray problem is dealt with through the use of the mask system for shielding a portion of the article and its holding chuck from overspray of the powdered plastic compound in its movement through the article treatment zone. The mask system in the apparatus comprises complementary, counter rotating endless chains as carriers for pairs of shields. The paths of the carriers extend in parallel, side by side relationship through the article treating zone such that pairs of the shields assume a juxtaposed position encircling the upper portion of the article undergoing treatment, thereby shielding the upper portion of the article, the chuck mechanism carrying the article and the conveyor equipment therefor during the movement through a powder spraying booth located at one side of the mask or shield. In use of the pairs of shields through repeated cycles of spraying articles, some of the powdered compound adheres to the mask shield elements. Periodically, to avoid contamination of future articles to be sprayed, the mask shields must be cleaned. Heretofore, cleaning was done manually requiring shut-down of coating machinery, taking it out of production.

This problem is recognized in U.S. Pat. No. 3,909,289, in which the conveyor chucks are cleaned by a method of impinging a flame on the chucks for charring the compound, brushing the chucks and quenching them with water spray and thereafter directing a stream of air under pressure onto the chucks to remove the residue.

SUMMARY OF THE INVENTION

The present invention provides an apparatus for automatically cleaning the shields of the mask system during operation of the coating machine, and cleaning them before each spraying cycle during which each individual pair of shields is used. The cleaning apparatus is comprised of a brushing system along the path of the shields and includes means for collecting and reusing the powder cleaned from the shields.

The shields are contoured and mounted on an endless carrier which operates in two closed loop paths that include parallel spans of travel through the spray treatment zone. In the parallel segments, each corresponding pair of shields assumes a juxtaposed position masking the article and its holding chuck in a desired manner. Two cleaning devices or assemblies are used, one for each of the shields of the pair of shields. The articles treated are, by way of example, glass bottles onto which a finely divided thermoplastic powder is sprayed in the treatment zone to coat a portion of the bottle's outer surface below the neck finish. Inasmuch as some of the powder adheres to the shields, and undesirable build-up of residue powder contaminates further bottles handled through the mask system and the latter must be cleaned.

The invention provides an automatic mask cleaner which may function continuously during normal operation of the masks in the spraying process. The mask cleaner device uses contoured brushes rotated by a motor to sweep the excess powder off the mask just after completion of one spraying cycle and before the reuse of the mask in the spraying zone upon closing about the neck of a bottle. The device also incorporates blow air applied to remove powder particles from cracks and crevices of the shields and the nearby carrier structure on which it is connected. The brushes are enclosed in a metal housing kept under negative pressure which is connected to a powder collection system. The collector can be a separate system or a part of the powder supply connected to the spray gun apparatus for spray treatment of the bottles. In either way, the cleaned powder residue may be recycled resulting in some saving of material that would otherwise be lost.

An important object of the invention is to keep excess powder off the bottle necks and avoid excess powder on the masks from coming in contact with the neck of the bottle.

Another object of the invention is to prevent powder residue build-up on the masks which may be vibrated loose and fall onto the bottle coating in globs or cakes, which will be fused with the sprayed coating when the latter is cured, thereby forming a defect in the final plastic coating on the bottle.

These and other objects and advantages will become readily apparent from the following description of a preferred embodiment of the apparatus of the invention and from the drawings, hereinafter described.

DETAILED DESCRIPTION OF A PREFERRED EMBODIMENT

Figure 1:
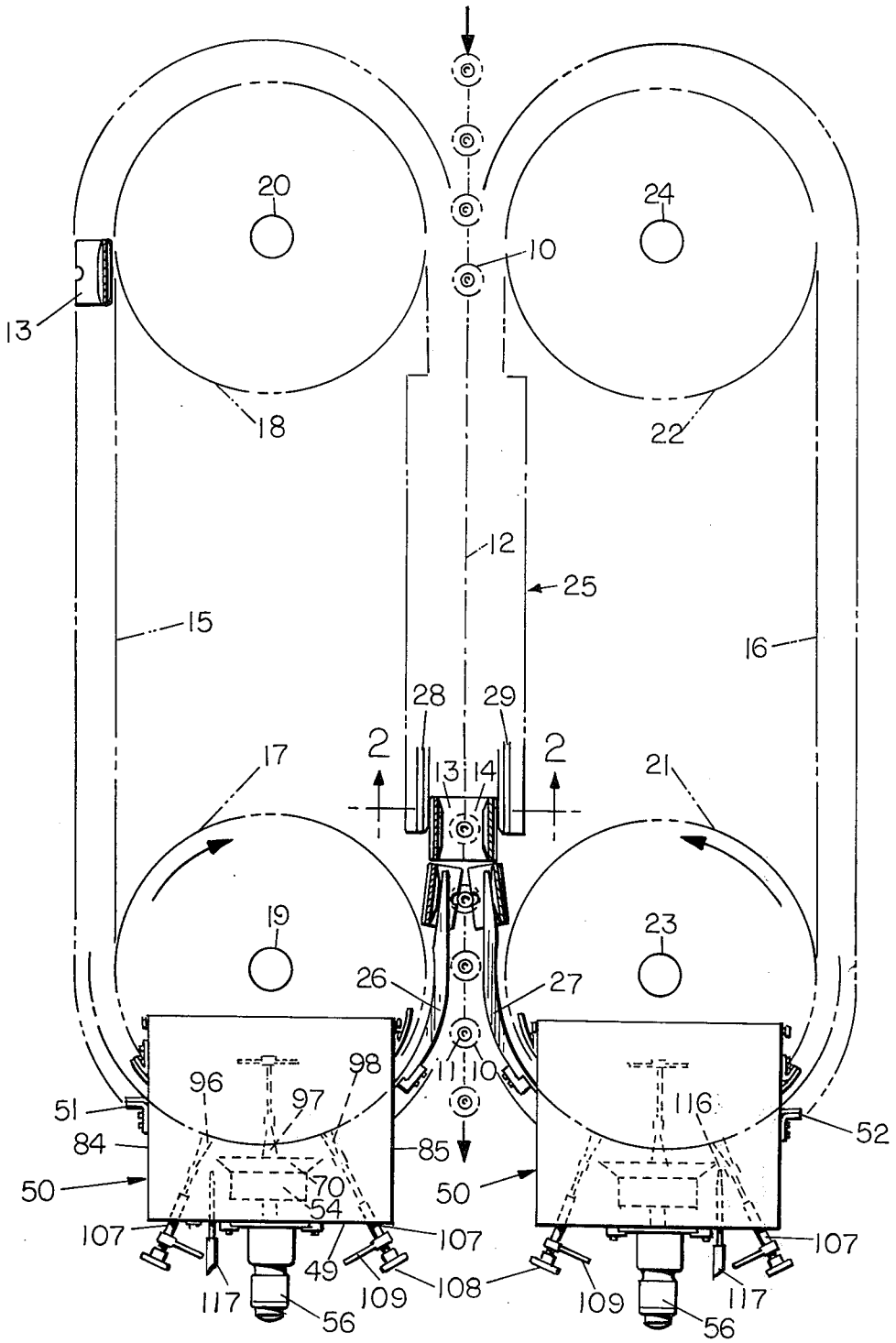
FIG. 1 is a top plan view, in part schematic, of the apparatus of the invention in its operational environment.
Figure 2:
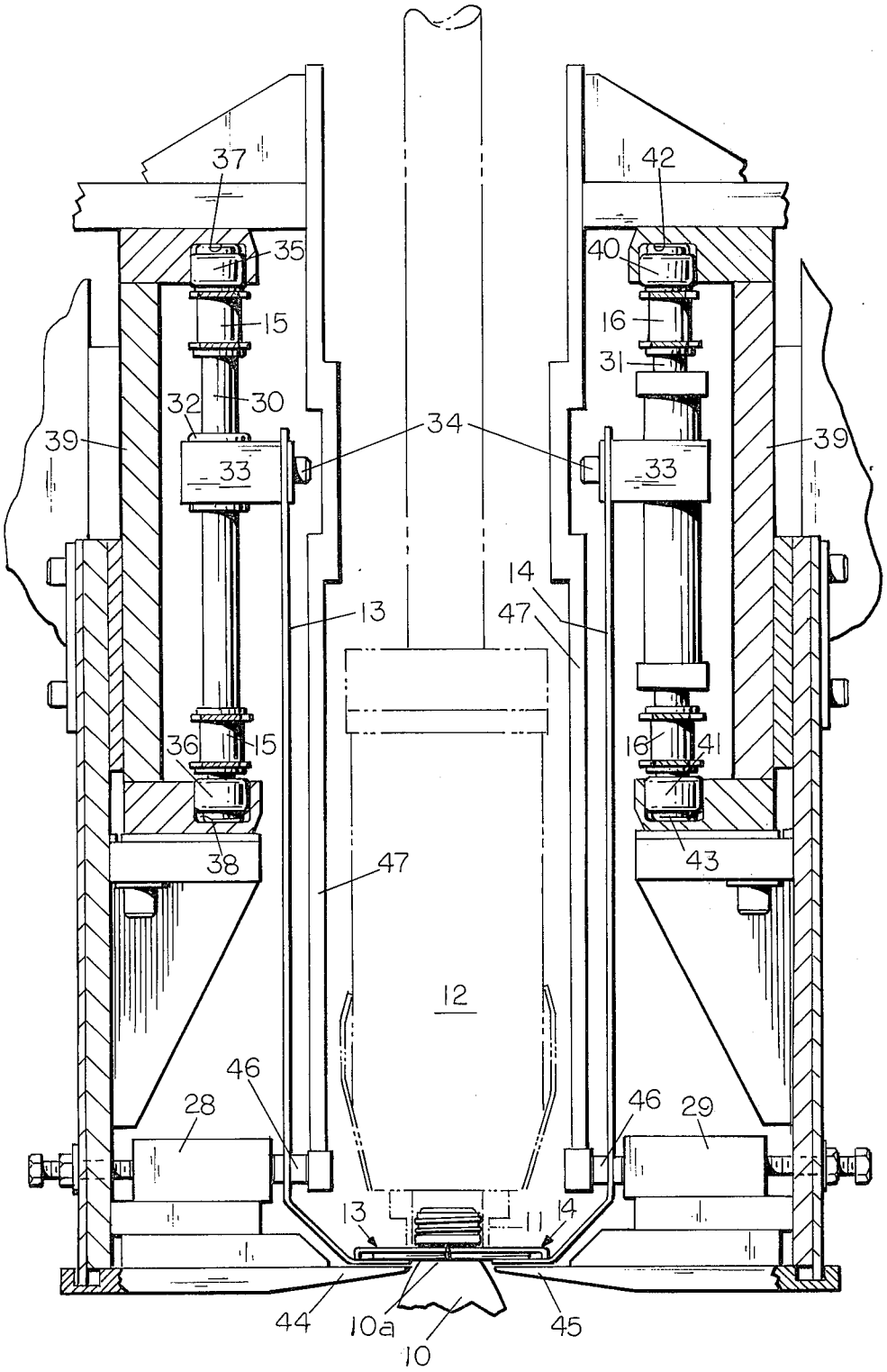
FIG. 2 is a sectional elevational view of a part of the apparatus of FIG. 1, taken along line 2—2 thereon.

The spray coating system with the masks, shown in part schematically, and inclusive of the present invention, is illustrated generally on FIG. 1 in its operating environment. FIG. 2 shows in detail the function of the masks in a spray treatment zone of the apparatus. FIGS. 1 and 2 will now be described for a general understanding of the operation of the spray coating apparatus.

The spray mask means is connected to move in synchronism with a plurality of articles, such as glass bottles 10 supported on chucks 11 carried by a straight line segment of a bottle conveyor 12 indicated by the dashed line on FIG. 1. The mask system comprises a series of L-shaped shields 13, 14 (FIG. 2) carried respectively by the left-hand chain means 15 and right-hand chain means 16. Chain means 15 includes upper and lower closed loop link chains reeved about pairs of upper and lower end sprockets 17 and 18, the pairs being each supported on their individual vertical shafts 19 and 20. Chain means 16 similarly comprises upper and lower closed loop link chains reeved about pairs of upper and lower end sprockets 21 and 22 which pairs are supported on their individual vertical shafts 23 and 24. The chains 15 and 16 are driven in counter directions of rotation by a motor that is synchronized for moving the shields 13, 14 therewith in step with the travel of the bottles on conveyor 12. This drive is more specifically described in U.S. Pat. No. 3,886,899 incorporated herein by reference. The path of the shields 13, 14 is as cooperating pairs moving on opposite sides of the bottles 10 and conveyor 12 therefor through a parallel span traversing the spray treatment zone 25 for spray coating the surface of the bottles depending below shields 13, 14 therein. On FIG. 1, the shrouds and casings about the shields are not shown for clarity of illustration. The movement of bottles 10 by conveyor 12 is in the direction indicated by the arrow. As the shields 13, 14 of the mask system pass around the sprockets 18 and 22 and approach the path paralleling conveyor 12, an arcuate opening cam forces shields 13 away from the path of bottles 10 and a similar but oppositely curved arcuate cam forces shields 14 away from said path. This allows bottles 10 to enter between the pair of shields 13, 14 without interference. After this is accomplished and the end turn for shields 13, 14 is traversed, these cams come to an end, whereupon shields 13, 14, as pairs, come together and the arcuate cut-out configuration on the inner face of shields 13, 14 allow the pair in juxtaposed relationship to encircle the neck finish 10*a* of the bottle. After shields 13, 14 have been closed, they protect and mask off the upper portion of the bottle 10 for spray treatment of the lower portion thereof in zone 25. In travel through treatment zone 25, a holding cam 28 engages the shield 13 and a corresponding holding cam 29 engages shield 14 which together maintain the shields in closed position sealed about the neck 10*a* of the bottle throughout the treatment zone. After leaving the treatment zone, the shields are opened from the bottle neck by arcuate cams 26 and 27 and the shields pass around their respective end turn sprockets 17 and 21 for a return toward their next spraying cycle.

FIG. 2 shows further details of the masking system in the treating zone. The upper and lower chain 15 are connected by pins 30 and upper and lower chains 16 are connected similarly by pins 31. A support tube 32 is adjustably fastened on pins 30 and includes a lateral block 33 connected to the upper end of the L-shaped shield 13 and secured by a fastener 34. Similar block 33 is provided on pin 31 fastening the upper end of shield 14 thereto. Shields 13 and 14 are similarly constructed of thin spring steel material and are cantilever mounted on the block 33 carried by the respective chains. This allows a considerable lateral spring effect at the lower portion of the shields adjacent the bottle. The vertical legs of shields 13 and 14 are integral with a sloped transitional portion and the terminal horizontal portion included with the semi-circular cut-outs of the jaws that surround the bottle neck. The path of travel of the upper and lower chains 15 is controlled, at least through the treatment zone 25, by rollers 35 and 36 attached at the opposite ends of pin 30 and running in the upper cam track 37 and lower cam track 38, respectively, as part of the frame 39. In like fashion, rollers 40 and 41 on the ends of pins 31 run in the upper and lower cam tracks 42 and 43 connected on the opposite side of the frame 39. The shields 13, 14 ride over a secondary lower shield comprised of horizontal strips 44 and 45 which are stationary on frame 39 and spaced slightly at their inner edges from the surface of the neck 10*a* of the bottle. The horizontal strips 44, 45 extend only the length of treatment zone 25 (FIG. 1). The lower part of the vertical spring segment of each of the shields 13 and 14 carry a cam follower 46 clipped thereon which slide over the respective cams 28 and 29 (described earlier) for assuring the closed position of the pair of shields about the bottle neck. The ends of cams 46 facing the path of the conveyor 12 ride under the housing plates 47 which provide dust covers for the carrier and chain mechanisms.

THE CLEANING DEVICE

Referring briefly to FIG. 1, a cleaning device 50 is mounted on the outer turn of each of the pairs of chains 15 and 16 over the end sprockets 17 and 21. Each cleaning device is constructed substantially the same and is supported on vertical columns 51 and 52 as a part of the machine frame.

Figure 3:
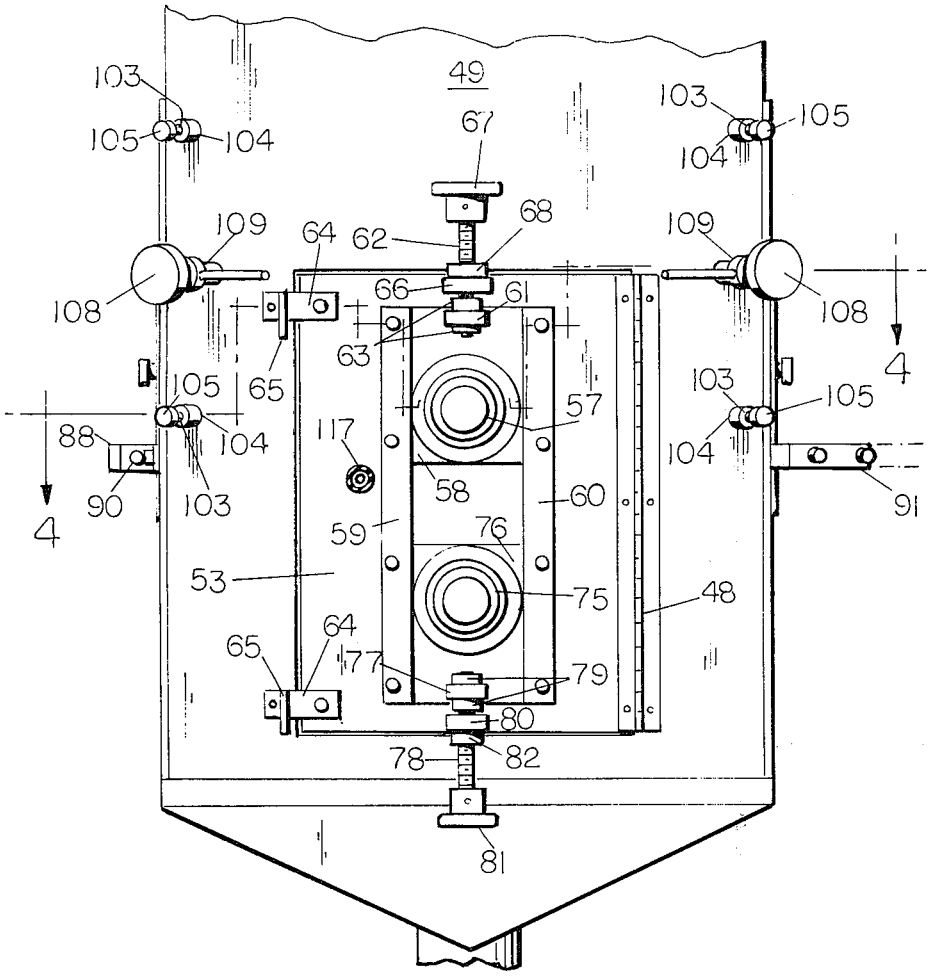
FIG. 3 is a front elevational view of one of the mask cleaning devices of the invention.

One of the cleaning devices 50 will be described with reference to FIGS. 3–5. A vertical wall panel of the back wall 49 provides a support for an upper cylindrical rotary brush 54 rotatably supported by a horizontal shaft 55 fastened to the output shaft and driven by motor 56. As will be apparent hereinafter, the wall panel 53 is mounted in place along one vertical side by hinge 48 and fastened closed by pivotal bars 64 which fit into the notched keepers 65 on the back wall 49. The wall panel 53 provides a mounting for the brush assemblies which serves also as a door which may be swung out to work on the brushes. The motor housing 57 includes a flat plate 58. The vertical edges of plate 58 fit within the vertical slides 59 and 60 integrally fastened on wall panel 53. The plate 58 is held in a vertically adjusted operating position for motor 56 by the lateral arm 61 integral therewith, which rotatably supports the end of threaded shaft 62 and fastened by spaced fasteners 63. Shaft 62 is rotatable in matching screw threads in the centilever arm 66 integral on the upper part of wall panel 53. The vertical position on shaft 62 is set at turn knob 67 keyed on the end of that shaft. Thusly, the vertical height of the motor 56 and brush 54 may be adjusted along wall panel 53 by turning the knob 67 the proper direction and amount. A locking lever 68 is thread connected on shaft 62 above arm 66. After the motor and brush are set in operating position, the locking lever 68 is turned down tightly against arm 66 locking the suspended position of the motor and brush assembly. Shaft 55 passes freely through an elongated vertical slot 69 for rotation.

A lower contoured circular brush 70 is comprised of a cylindrical segment of bristles 70*a* and an integral frusto conically shaped segment 70*b*. The bristle segments 70*a*, 70*b* are fastened on a tubular hub 71 encircling the end of horizontal shaft 72 and fastened by axial bolt 73. Shaft 72 is fastened onto the end of motor shaft 74 which is driven by motor 75. The motor housing includes a flat plate 76 and the vertical edges thereof are retained within the vertical slides 59 and 60 in the same manner as motor 56. The plate 76 is held in a vertically adjusted operating position for motor 75 by its lateral arm 77. The end of a threaded shaft 78 is rotatably held in lateral arm 77 by spaced rotatable fasteners 79 which affix the shaft to the arm. The threads of shaft 78 rotatably engage matching threads in the centilever arm 80 integrally a part of wall panel 53 and located near the lower portion thereof. Shaft 78 includes end knob 81 for turning it in opposite directions to adjust the vertical height of the lower motor-bush assembly, just described. The brush shaft 72 extends through a vertically elongated slot 83 in panel 53 for height adjustment of this brush assembly. When in position, the lower locking lever 82 which is threaded connected on shaft 78 below arm 80 is tightened to lock the parts in operating position.

Figure 4:
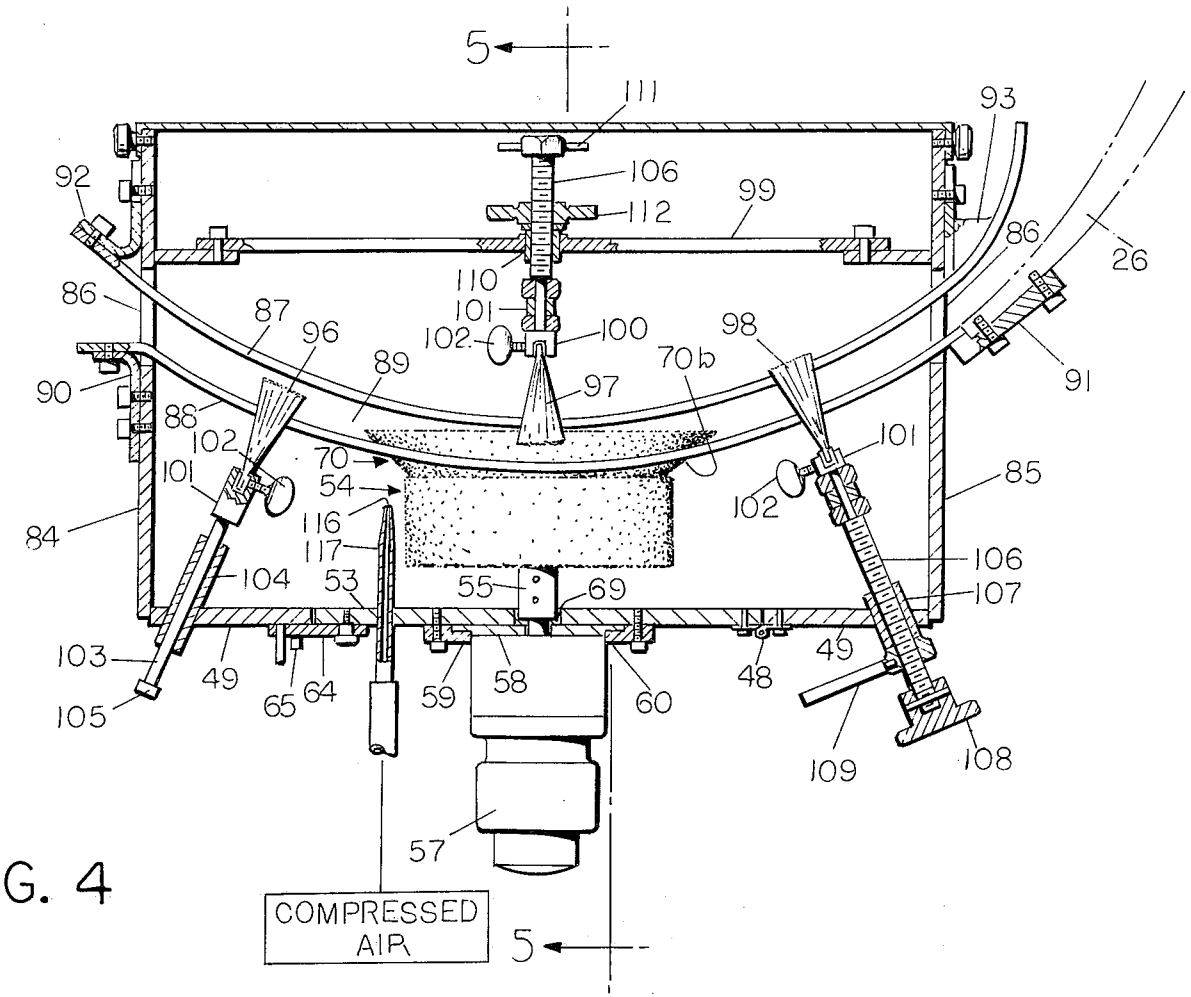
FIG. 4 is a sectional top plan view taken along line 4—4 on FIG. 3.

As best seen on FIG. 4, the vertical back wall 49 of the cleaner housing is attached to opposite vertical side walls 84 and 85 each of which has a vertical opening 86 in the form of an L-shaped slot for passing the masking shields (13 or 14, as case may be) through the cleaning device. For this conveyed arcuate spaced apart guide rails 87 and 88 are provided to define a guide path 89 for the shields through the cleaner. The front end of outer guide rail 88 is bolted onto side wall 84 by the angle cleat 90 and the other rear end of the guide rail is bolted onto the end of cam 26 at the clamp 91. Similarly, the inner guide rail 87 has its front end bolted to wall 84 by the angled cleat 92 and the rear end bolted to wall 85 by its integral bracket 93. The rear end of rail 87 is curved back toward wall 85 and out of any path for interference with the shields after leaving the cleaning device and being "opened" by the front cam (26 or 27, as the case may be). The housing for the cleaner also includes a top wall 94 having a slotted opening 95 therein corresponding substantially in contour with the guide path 89 and continuous with the side openings 86 in the walls for passage of the spring L-shaped shields through the housing of the cleaner.

Figure 5:
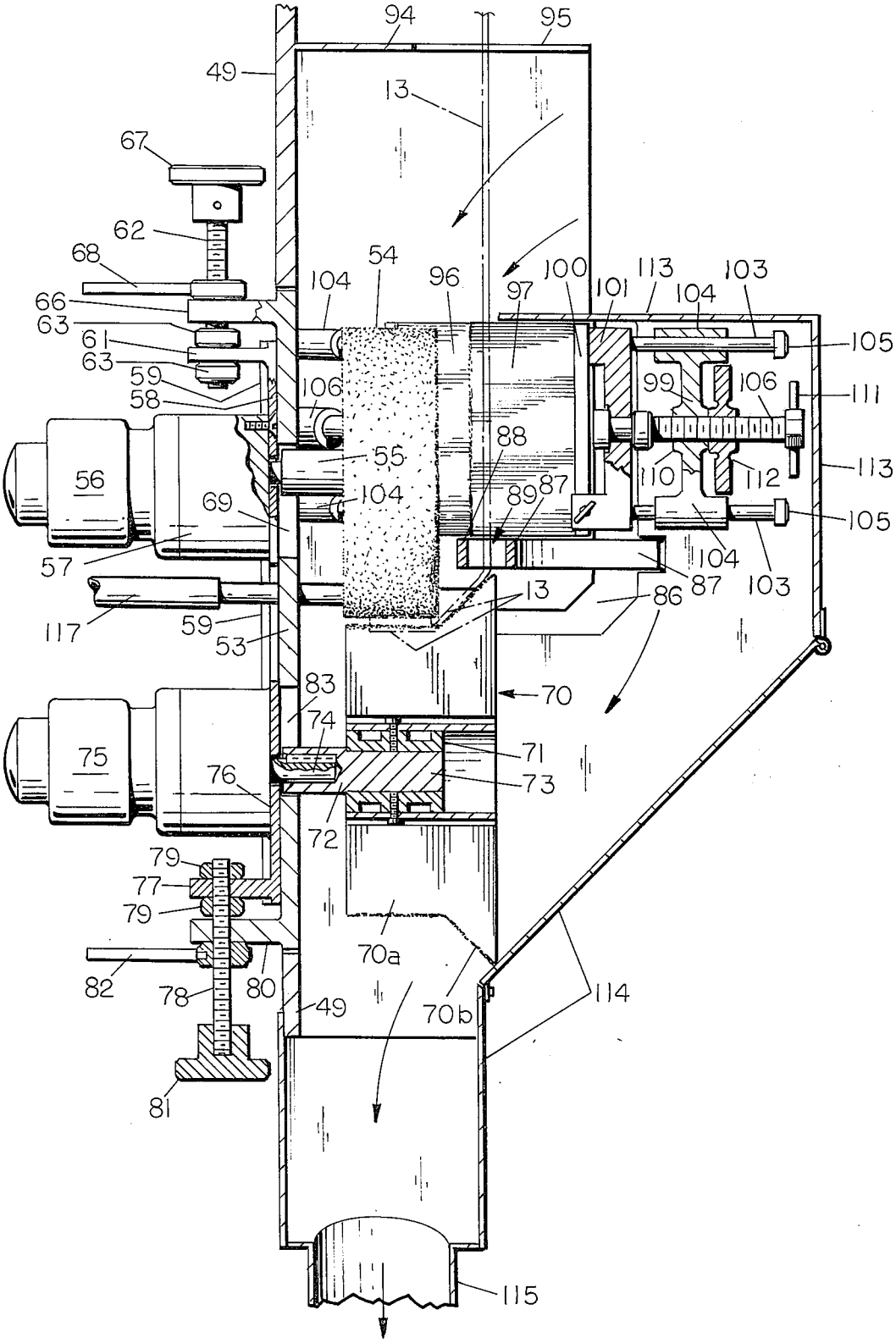
FIG. 5 is a sectional elevational view taken along line 5—5 of FIG. 4.

During movement of each of the shields (13 or 14) through the cleaner guide path 89, the lower surface of its horizontal leg will be brushed by engagement of the bristles on the cylindrical portion 70*a* of the lower brush (FIG. 5). The underside of the angular transitional portion of the shield will be brushed by the bristles of the sloped or frusto-conical portion 70*b* of the lower brush. Meanwhile, the upper surface of the horizontal portion of the shield will be brushed by the bristles of the upper cylindrical rotating brush 54. The vertical lower part of the shields are cleaned by movement across three stationary vertically elongated brush assemblies.

Assuming movement from right to left of the shields through path 89 (FIG. 4), a first brush 98 is mounted in back wall 49 and angled inwardly so that brush 98 overlies guide rail 88 and extends into path 89. A second intermediate stationary brush 97 is mounted on an interior vertical narrow wall 99 end connected to the side walls 84, 85 of the housing. Brush 97 overlies the inner guide rail 87 and extends into path 89. The third stationary brush 96 is mounted as brush 98 and overlies the guide rail 88 aft of the rotary brushes.

Figure 6:
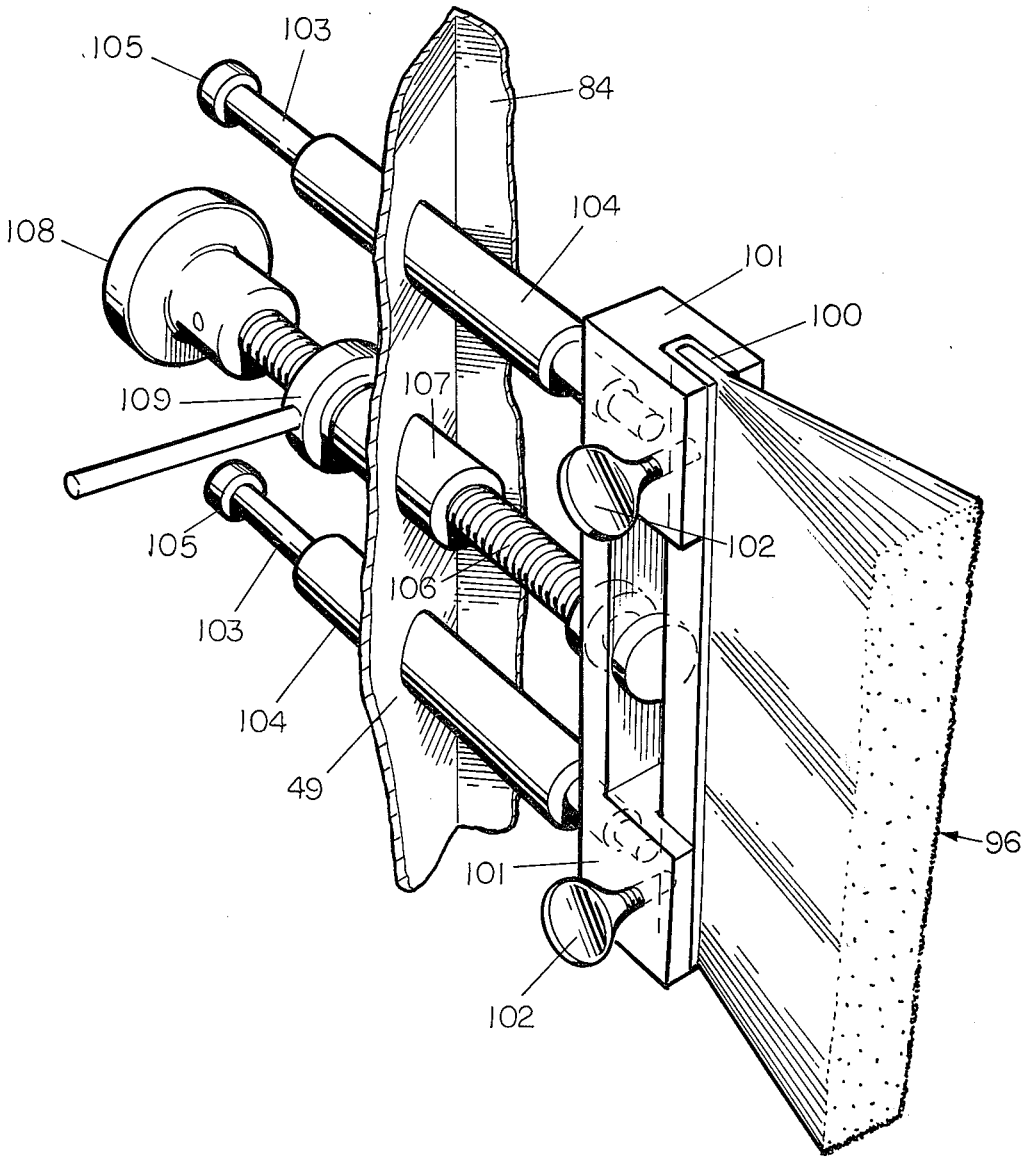
FIG. 6 is a three-quarter perspective view of one of the front brush assemblies used in the mask cleaning devices shown on FIG. 3.

The details of the mounting of brushes 96 and 98 are substantially the same structure as shown on FIG. 6. The brush 96, for example, comprises a relatively stiff bristle array clamped at the rear side in a retainer 100. The brush is detachably fastened in a vertical jaw-type holder 101 and secured therein by upper and lower thumb screws 102. Upper and lower slide rods 103 are screw thread connected into the back of holder 101 near the top and bottom ends thereof. Rods 103 are inserted slidably through hollow tubular bearings 104, fastened, such as by welding, in the back wall 49. The outer end of rods 103 include a stop lug (enlargement) 105 limiting the inward movement of the brush. The upper and lower rods 103 serve as a guide for the elongated brush to hold it vertical in operation and for operating the forward and back adjustment. This adjustment into or away from the path 89 for travel of the shields is provided by the threaded shaft 106. The inner end of shaft 106 is rotatably connected on the central back of holder 101 and engages matching threads in the sleeve 107 fastened firmly in wall 49. Shaft 106 has a turning knob 108 on its outer end for advancing or retracting it in sleeve 107. A locking lever 109 is threaded on shaft 106 outside sleeve 107. After adjusting the brush 96 in relation to the path of the shields 13 (or 14) through the cleaner 50, the locking lever 109 is tightened against the end of sleeve 107 locking the brush in operating position. The adjustment and mounting of brush 98 is the same as just described.

Referring again to FIG. 4, brush 97 comprises a vertical array of bristles similar to brush 96 retained in a vertical jaw-type holder 101. The holder 101 is connected to upper and lower rods, such as is shown on FIG. 5, which fit through sleeve guides 104 attached on the wall 99 above and below the centrally located threaded shaft 106. The wall 99 includes a central boss 110 tapped with matching threads and shaft 106 is engaged with these threads for advancing or retracting brush 97. Shaft 106 includes and end handle 111 for turning adjustment. The inner end of shaft 106 is rotatably connected onto the back of holder 101. Brush 97 is adjusted in overlying relationship to the guide rail 87 to extend into the guide path 89 for movement of the shields (such as 13). The position of brush 97 is locked in place by tightening lock nut 112 on shaft 106 against the back side of boss 110.

OPERATION

Referring mainly to FIGS. 1, 4 and 5, the shields 13 and 14 pass through a cycle in which they mask off a portion of the article, the neck of the bottle in this example, during spray coating the rest of the article. Thereafter, the shields 13 and 14 separate in a return path which includes movement through a cleaner device 50. Looking at FIGS. 4 and 5, the flexible shield is conveyed into the device at the opening 86 therein and passes in the arcuate path 89 by defined by arcuate rails 87 and 88. Of course, the cleaning device 50 could be constructed to receive the conveyed shields on a straight span, such as the back side of the chain loop 15. In this case, the guide rails would be straight and the brushes 96–98 mounted accordingly.

After entry in the cleaner along path 89, the first brush 98 engages the front side of the lower vertical segment of the shield 13 or 14, and brushes any residue therefrom. The brush 98 will apply some pressure laterally against this vertical resilient part of the shield, and the shield may yield away from brush 98 until engaging the guide rail 87. Next, the shield moves to be engaged by the second brush 97 which similarly brushes the back face of its vertical segment. Simultaneously, the underside of the horizontal segment of the shield engages the cylindrical portion 70*a* of brush 70 and the angular transition leg is brushed at the same time by portion 70*b* of that brush. The top surface of the horizontal leg of the shield is brushed by the cylindrical brush 54. Thereafter, the shield moves past brush 96 and front face of the vertical leg of the shield is again brushed clean.

The cleaning device 50 is enclosed on the back side by a sheet metal cover 113 and a lower sheet metal chute 114 which is sloped downwardly and inwardly in fashion of a funnel connected to a pipe 115. The pipe 115 is connected to a blower of any known type (not shown) to induce a flow of air from the housing (see arrows on FIG. 5) and maintain a negative pressure in the housing chamber. The air flow will entrain brushed particles of powder residue cleaned from the shields and convey the powder through pipe 115. This pipe 115 may be connected to the powder supply in any convenient fashion such that the cleaned powder is recycled for use with the supply in spray coating articles. Otherwise, pipe 115 may be connected to a separate collector for the cleaned residue, if for some reason it is not desirable to mingle the cleaned powder in the supply thereof directly.

The blower, by inducing the air flow in the cleaner chamber as mentioned, also brings air into the housing through the openings 86 for the shield passing therethrough. The flow of air into and through the cleaner to pipe 115, as indicated by arrows on FIG. 5, provides a turbulence which might be called "blow air" to remove residue powder out of cracks and crevices in the mask machinery inclusive of the shields 13, 14.

In the description, motors 56 and 75 may be any type for providing rotary power to the brushes 54 and 70. However, in a fine powder environment wherein spark hazard may cause an explosion, the motors 54 and 70 are preferably air operated motors, which are commercially available. An example of such motor suitable for use on the present embodiment is Model 1AM-NRV-56 reversible air motor and GR-11 gear reducer (15:1 reduction) sold by the Gast Mfg. Corporation of Benton Harbor, Michigan.

A blow air assist may be used, optionally, to scrub off the inner angled face of the inclined transitional leg of the shield. This is illustrated on FIGS. 4 and 5 by the air nozzle 116 aimed to cover that area of the shield just after it passes through the rotary brushes 54 and 70. The air nozzle is connected with pipe 117 that is attached to a compressed air source, including a shut-off valve (not shown) of known type.

Having described a preferred embodiment of the apparatus, other modifications and advantages thereof will become readily apparent to those of ordinary skill in the art without departing from the spirit and scope of the invention, as is defined in the appended claims.

What is claimed is:

1. In combination:

a means for masking a portion of articles which are traveling in a substantially linear path through an article treatment zone comprising a plurality of masks each comprising a pair of complementary shields for masking one portion of the article from exposure to the treatment zone, a carriage for one of the shields of said pair thereof operable in a path on one side of the travel of the articles, and a carriage for the other of the shields of said pair thereof operable in a path on the opposite side of the travel of the articles, the carriages being operated in unison through their paths of movement for bringing the shields of each pair together and moving them with the traveling articles and surrounding an article in a juxtaposed position prior to entry of the treatment zone and maintaining them in said position through said zone, thereafter separating said shields and carrying them back to the beginning of the treatment zone, and a shield cleaning device individual to each carriage, means supporting said cleaning device along the path of said carriage outside of the treatment zone for movement of the shields through the cleaning device, said cleaning device comprising a frame, a first rotary brush, means connected to the frame rotatably supporting the first rotary brush on one side of the shields for engaging the adjacent surface thereof, a second rotary brush, means connected to the frame rotatably supporting the second rotary brush on the opposite side of the shields for engaging the surface adjacent thereto, a plurality of elongated brushes, means supporting each of the brushes on the frame disposed at opposite sides of the shields for engagement of the brushes along opposite surfaces of each of the shields during movement through the cleaning device, and motor operated drive means connected to operate said first and second rotary brushes.

2. The combination of claim 1, in which each of said shields of the complementary pairs thereof comprises a thin, angled, L-shaped flexible member having one leg thereof attached at its one end to the shield carriage, another leg lateral thereto depending freely and being contoured for masking the article, said first and second rotary brushes engaging opposite surfaces of said free leg, and said plurality of elongated brushes engaging opposite surfaces of the said one leg.

3. The combination of claim 2, wherein the cleaning device includes substantially parallel, spaced apart guide rails defining the path of the L-shaped shields therethrough, said guide rails limiting deflection of the shields during brushing engagement by said plural brushes in the cleaning device.

4. The combination of claim 1, wherein the L-shaped shields include a terminal leg portion supported on the shield carriage, a free leg portion disposed substantially normal to the terminal leg, and an angular transition portion connecting the free leg and terminal leg, the first rotary brush being of cylindrical configuration for engaging the one surface of the free leg of said shields, and the second brush being of a combined cylindrical and frusto-conical configuration, the cylindrical portion thereof engaging the opposite surface of the free leg of said shields and the frusto-conical portion thereof engaging one surface of the angular transition portion of said shields.

5. The combination of claim 1, in which the motor-operated drive means connected to operate the first and second rotary brushes comprises a fluid-operated rotary motor connected to said brushes for rotating them.

6. The combination of claim 5, there being two fluid-operating rotary motors connected individually to the first and second rotary brushes.

7. The combination of claim 6, in which said fluid-operated rotary motors are air-operated motors.

8. The combination of claim 1, wherein the means supporting the first and second rotary brushes on the frame comprise a wall panel supported by said frame, parallel slides on said panel, a central shaft for each said first and second brushes, first and second motors connected, respectively, to the shafts of said first and second brushes, said first and second motors each including a motor mount slidable along said slides, a first threaded support on said frame, a screw connected at one end to the first motor mount and threadedly connected to said support for adjusting the position of the first motor and shaft of the first brush with respect to the path of said shield, a second threaded support on said frame spaced from the first support, a second screw connected at one end to said second motor mount and threadedly connected to said second support for adjusting the position of the second motor with respect to the path of the shield.

9. The combination of claim 8, wherein said wall panel is hinged on said frame and movable into and out of operating position, whereby the brushes may be swung into and away from the path of the shields.

10. The combination of claim 1, which includes an enclosure surrounding the cleaning device, said enclosure including openings for passage of the shields therethrough, conduit means connected to said enclosure for conducting air from the enclosure and adapted to place the interior of the cleaning device under negative pressure, the material cleaned from the shields within the enclosure being carried from the cleaning device by said conduit means.

11. The combination of claim 1, including a source of pressurized air, an air nozzle supported by the frame, conduit means connecting said source and said nozzle, the latter being disposed adjacent the path of the shields and directed for blowing the pressurized air onto a surface portion of the shield traveling through the cleaning device.

12. The combination of claim 1, wherein the means supporting each of the elongated brushes on the frame comprises a pair of rods each connected to the elongated brush in the proximity of one of its ends, individual guides connected on the frame and in sliding relationship with said rods, a threaded shaft parallel to said rods and connected at one end to the elongated brush intermediate said rods, and a threaded sleeve connected to the frame engaging the threads of the shaft, whereby rotary movement of said shaft adjusts the position of the elongated brush with respect to the shields.

13. In an apparatus wherein a plurality of articles are transported in a single file through a treatment area and a portion of the articles is coated in the treatment area with a treatment material and another portion thereof is not coated, the apparatus including a mask system comprised of a complementary pairs of article shields each of which is conveyed in a separate closed path, each including travel through the treatment area and which assume a juxtaposed position of the shields surrounding the article masking the portion thereof not to be coated in the treatment area, the improvement therein comprising a pair of cleaning devices for engaging the shields during their travel outside the treatment area during each cycle of movement in their separate closed paths, each of the cleaning devices comprising a housing through which the shields are adapted to travel in single line, a pair of rotary brush means, means supporting each of the brush means in said housing for engaging an opposite surface of said shields during said travel, the brush means being disposed on opposite sides of the path of the shields through the housing, a motor means connected to rotate the brush means, and elongated brushes mounted in said housing on opposite sides of said path therethrough of said shields for engaging opposite surfaces of the shields as they move therethrough, the elongated brushes engaging opposite surfaces of the shields, said rotary and elongated brushes combining to remove any residue of treatment material after each cycle of movement through the treatment area and prior to their next movement through said area.

14. The apparatus of claim 13, including means connected into said housing for maintaining the cleaning device at negative pressure.

15. The apparatus of claim 13 including spaced apart, substantially parallel guide rails mounted within said housing and defining a guide path for the shields corresponding with relatively free movement of the shields through the cleaner, said guide rails each limiting lateral flexing movement of shields normal to the direction of movement thereof when engaged by the brushes in the cleaning device.

16. The apparatus of claim 13, including a source of pressurized gas, a gas nozzle means, conduit means connecting said source and said nozzle means, means for mounting the nozzle means in the housing and along the path of movement of the shields therein directing gas issued by the nozzle means onto a surface of the shield.

* * * * *